US005259422A

United States Patent [19]

Vezzu

[11] Patent Number: 5,259,422

[45] Date of Patent: Nov. 9, 1993

[54] MECHANISM FOR THE ACCELERATION OF THE PROJECTILE OF A PROJECTILE LOOM

[75] Inventor: Danilo Vezzu, Rüti, Switzerland

[73] Assignee: Gebrueder Sulzer Aktiengesellschaft, Winterthur, Switzerland

[21] Appl. No.: 965,103

[22] Filed: Oct. 22, 1992

[30] Foreign Application Priority Data

Dec. 3, 1991 [CH] Switzerland ..... 3546/91-7

[51] Int. Cl.[5] ..... D03D 49/32

[52] U.S. Cl. ..... 139/145; 267/273

[58] Field of Search ..... 139/196.2, 438, 439, 139/145; 267/277, 273

[56] References Cited

U.S. PATENT DOCUMENTS 2,715,422 8/1955 Pfarrwaller .
3,124,168 3/1964 Wohlgemuth et al. ..... 139/145
4,223,703 9/1980 Pfarrwaller ..... 139/145
4,922,967 5/1990 Pfarrwaller .

FOREIGN PATENT DOCUMENTS 473925 6/1969 Switzerland .
636655 6/1983 Switzerland .

*Primary Examiner*—Andrew M. Falik
*Attorney, Agent, or Firm*—Townsend and Townsend Khourie and Crew

[57] ABSTRACT

The mechanism for the acceleration of a projectile of a projectile loom has a torsion-bar launching mechanism (1) with a striker lever (3) which, at its end remote from the torsion bar (2), carries a striker piece (34) which, during launching, acts directly on an impact face (43) of the projectile (4). The projectile (4) for the loom has a casing formed of a hollow body and may be partially closed at the rear, as viewed in the direction of flight. The striker piece (34) can pivot on the striker lever (3) and has at least one striker face (33) which is aligned by an alignment member (5) so that at the instant just prior to triggering of the weft insertion the position of the striker face conforms to that of the impact face (43) of the projectile (4); that is, for example, the two are parallel. The transmitted impact energy is uniformly distributed over the impact face of the projectile (4), which advantageously reduces wear of the striker face (33) and impact face (43).

21 Claims, 5 Drawing Sheets

MECHANISM FOR THE ACCELERATION OF THE PROJECTILE OF A PROJECTILE LOOM

BACKGROUND OF THE INVENTION

The invention is concerned with a mechanism for the acceleration of the projectile of a projectile loom. It is further concerned with a projectile loom having the mechanism in accordance with the invention.

From the U.S. Pat. No. 4,922,967 a drive for the projectiles of a projectile loom is known in which a striker piece acts directly on the projectile guided in a straight guideway. The striker piece is fastened to a striker lever at the end of it remote from the torsion bar and moves along a practically circular path. The striker lever is in contact via the striker piece with the rear end of the projectile in the region of the impact face and accelerates it in a few milliseconds over a travel of a few centimeters with an acceleration of up to 30,000 m/sec$^2$ to velocities of up to 60 m/sec. The striker face on the striker piece as well as the impact face on the projectile are therefore subjected to heavy loads, which leads to corresponding wear.

SUMMARY OF THE INVENTION

The problem the invention seeks to solve is to create a mechanism for the acceleration of the projectile of looms which reduces the wear at the impact face of the projectile as well as at the striker face of the striker piece. In accordance with the invention the problem is solved by providing an active or passive alignment member which acts upon the striker piece and positions the striker piece in such a way that during the triggering of weft insertion a striker face on the striker piece is conformed to the shape of the impact face on the projectile.

The mechanism for accelerating the projectile of a projectile loom has a torsion-bar launching mechanism with a striker lever which, at the end of it remote from the torsion bar, includes a striker piece that acts directly upon the impact face of the projectile during launching. The projectile for the loom, which has a casing formed of a hollow body, may be partially closed at its rear end as viewed in the direction of flight. The striker piece can turn on the striker lever and has at least one striker face which is oriented by an alignment member in such a way that at the latest directly before, at or after the triggering of weft insertion the position of the striker face conforms to that of the impact face on the projectile as, for example, two faces lying in parallel or nearly in parallel. The impact energy is thereby transmitted to the projectile and uniformly distributed over its impact face. Wear of the striker face and impact face is thereby reduced.

As a further advantage, the definite positioning of the striker face permits the placement of the projectile in the launching mechanism with a small clearance between the striker face and the impact face, which reduces the blow against the impact face.

A further advantage is that during the phase of acceleration of the projectile the striker piece does not come into contact with the alignment member.

DETAILED DESCRIPTION OF THE PREFERRED EMBODIMENTS

Figure 1:
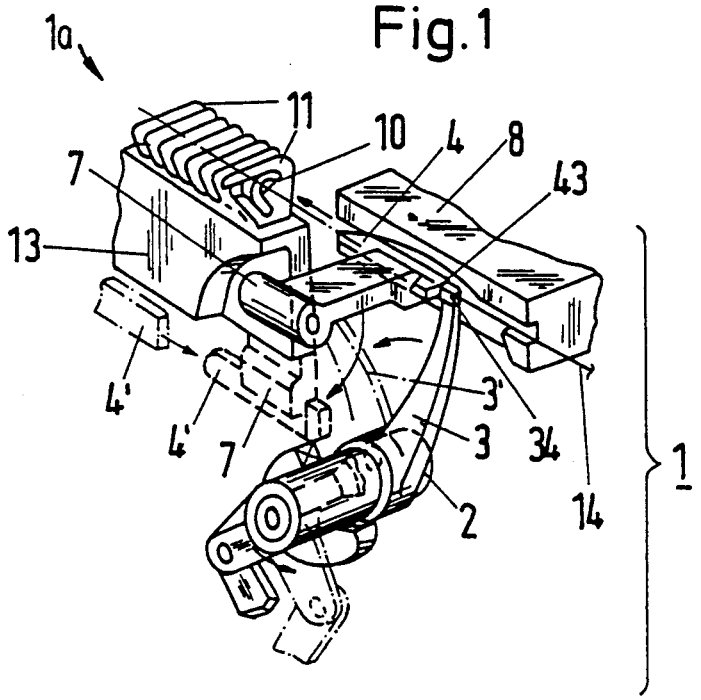
FIG. 1 shows part of the launching mechanism of a projectile loom constructed in accordance with the invention and illustrates, in broken lines, the projectile after the launching.

FIG. 1 shows a projectile accelerating mechanism 1 of a projectile loom generally indicated by reference numeral 1*a* but not otherwise illustrated in detail because such looms are well known to those skilled in the art. One end of a striker lever 3 is connected to the torsion bar 2 for pivotal movements therewith as the bar is torsionally stressed and unstressed. The other end of the striker lever 3 pivotally mounts a striker piece 34 forming a striker face 33. At the latest just prior to the triggering of the weft insertion the position of the latter conforms to that of the impact face 43 of the projectile 4. The projectile 4 has multiple guides in the launching direction and, after launching, enters a channel 10 formed through the shed of the loom by guide teeth 11 and in that manner carries in the weft yarn 14. The guide teeth are fitted to reed 13 of the loom. At its other end (not shown) torsion bar 2 is clamped firmly and at its other end is twisted and stressed. In FIG. 1 the spring-back of striker lever is represented by reference numeral 3' and is shown in dotted lines. The projectiles 4 are brought into the launching position, one after another, with a pivotable projectile lever 7. Projectiles 4' are moved from lever position 7', shown in dotted line, to the front of striker piece 34 on striker lever 3. In the case of known projectile looms the return transport of the projectiles 4' to the projectile lever position 7' is effected, for example, by a conveyor chain (not shown).

Figure 2:
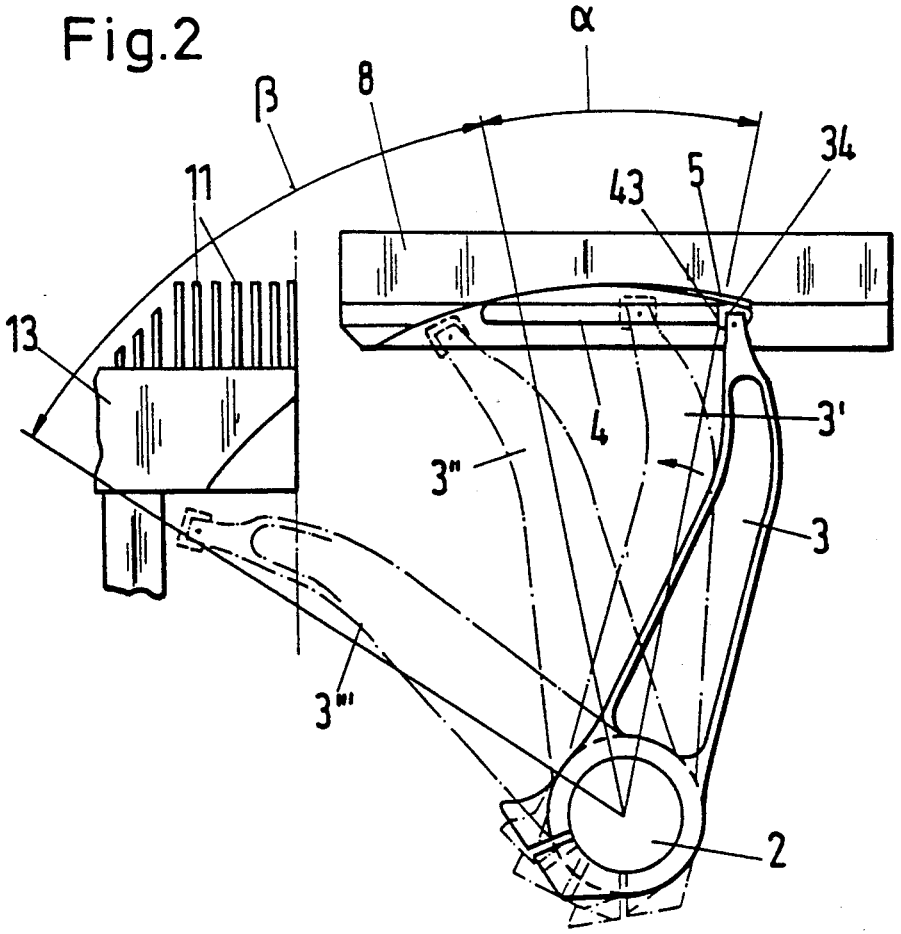
FIG. 2 shows a side elevation of a striker lever with its striker piece and with the projectile, in different positions during and after the launching of the projectile.

The launching of a projectile 4 and the turning motion of the striker lever 3 induced by torsion bar 2 are illustrated in FIG. 2. Two further positions are drawn in dotted lines at 3' and 3'' and the position of reversal of the striker lever is at 3'''. The launching phase has practically concluded when the striker lever 3 has pivoted through the angle $\alpha$, while the striker lever 3 continues to pivot through the angle $\beta$ to the position of reversal 3'''. During the stressing of the striker lever it is moved back again into its starting position 3, while between the starting position 3 and at least one part of the range of angle $\alpha$ an alignment member 5 influences the position of striker piece 34.

Figure 3A:
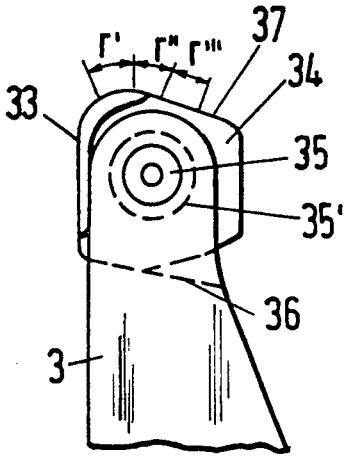
FIG. 3*a* shows a striker lever with a T-shaped striker piece able to turn through a certain angle.
Figure 3B:
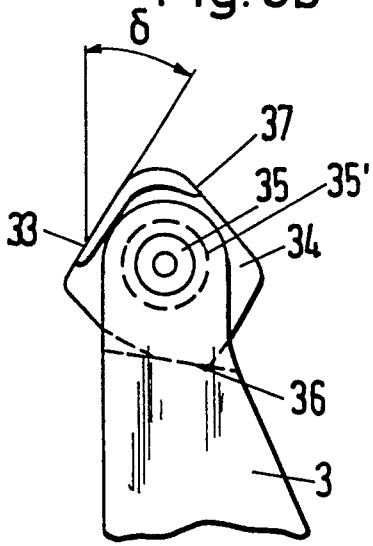
FIG. 3*b* shows the striker lever with the T-shaped striker piece turned.
Figure 3C:
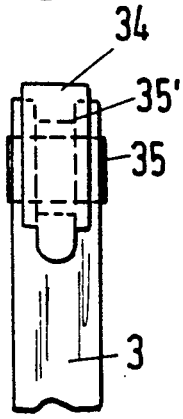
FIG. 3*c* shows a view of the striker lever in the launching direction.
Figure 3D:
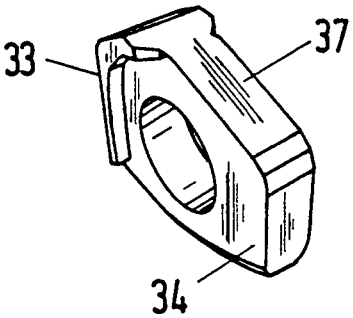
FIG. 3*d* shows a view of the T-shaped striker piece.

In FIG. 3*a* striker piece 34 is supported by a bushing 35' pressed onto a pin 35 so that it can pivot on striker lever 3 and it has a T-shaped flat striker face 33 which is widened in the launching direction. In the illustrated embodiment striker face 33 is in the launching position and perpendicular to the direction of launch. Launching positions of the striker face 33 which deviate from the perpendicular are also possible, the impact face 43 on the projectile being in each case parallel or approximately parallel to the striker face 33. The alignment member acts upon at least one face of the striker piece 34. Thus the area 37, for example, is suitable as a guideface for coming into contact with the alignment member 5. The stopface 36 as represented in FIG. 3*b* limits the angular play $\delta$ of the striker piece 34. FIG. 3*c* shows a view of the striker lever 3 with the striker piece 34 in the direction of launch. An embodiment is represented in FIG. 3*d* of a striker piece 34 having a striker face 33 and guideface 37. The striker piece 34 is preferably shaped so that it is counterbalanced as regards its pivoting about bushing 35'.

Figure 4A:
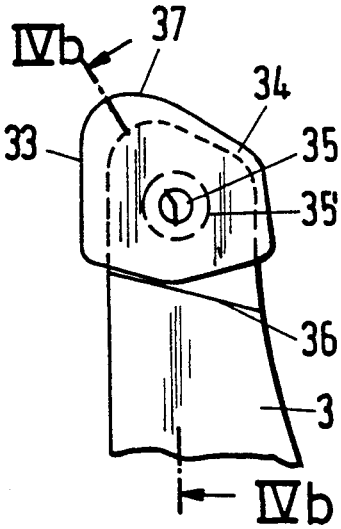
FIG. 4*a* shows a striker lever with a U-shaped striker piece.
Figure 4B:
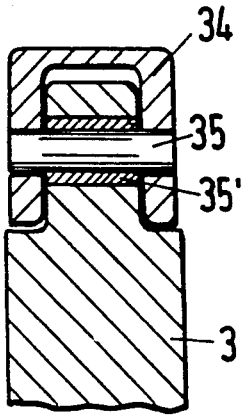
FIG. 4*b* shows a longitudinal section through the striker lever with the U-shaped striker piece.

FIGS. 4*a* and 4*b* show as a further embodiment a striker piece 34 made in the shape of a U. Functionally it is identical to the striker piece shown in FIG. 3*a*. The wide guideface 37 brings about a reduction in the surface pressure on the area touching the alignment member 5. A T-shaped widening of those regions of the guideface 37 which come into contact with the alignment member 5 can also be advantageously employed in the embodiment of FIG. 3*d*.

Figure 5:
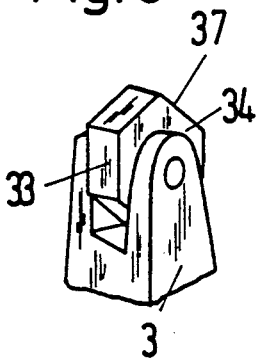
FIG. 5 shows a further form of a turnable striker piece.

In FIG. 5 striker piece 34 is shaped as a turnable polygon; e.g. as a hexagon, so that the different faces of the polygon may serve; e.g. successively as the striker face 33 or the guideface 37 respectively.

Figure 6A:
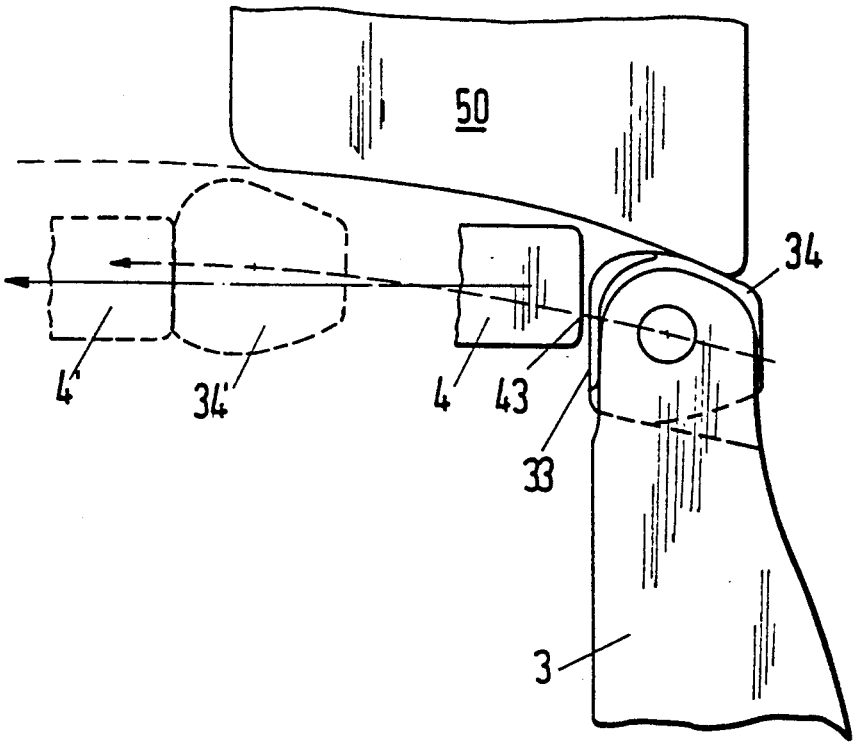
FIG. 6*a* shows an alignment member with the mutual positions of striker piece and projectile just prior to and, in broken lines, during weft delivery.

FIG. 6*a* shows striker lever 3, associated striker piece 34 as well as the projectile 4 in the launching position. Alignment member 50 fixes the position of striker face 33 on striker piece 34 parallel or approximately parallel to impact face 43 on projectile 4. The definite position of the striker face 33 allows projectile lever 7 to place projectile 4 in the launching position so that the distance between the impact face 43 and the striker face 33 typically amounts to a fraction of a millimeter. Upon triggering, striker face 33 preferably contacts impact face 43 with a negligibly low velocity and at a negligible angle between the striker face and the impact face and projectile 4 is increasingly accelerated when the two are in mutual contact. The guidebeam 8 forces projectile 4' along a linear path in the launching direction, whereas the striker piece 34' describes a circular path. Thus, while maintaining contact striker face 33 slides vertically to the weft direction across the impact face 43.

Figure 6B:
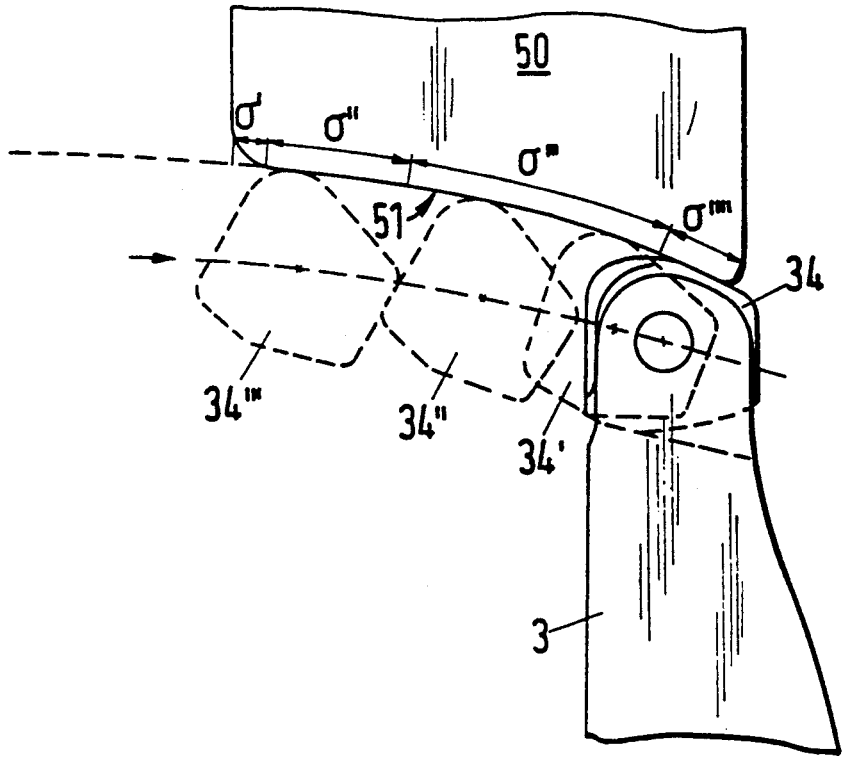
FIG. 6*b* shows the action of the alignment member on the position of the striker piece during the stressing of the striker lever.

FIG. 6*b* shows the striker lever 3 with the associated striker piece 34 after it has been fully stressed. It also shows different possible positions 34''', 34'' and 34' of the striker piece during the stressing of the striker lever. The striker piece 34 has an angular play $\delta$ and the shown positions 34', 34'' and 34''' of the striker piece were selected for illustration of the action of the guideface 51. Only one particular set of many possible positions, which are dependent upon the angular play $\delta$, are shown.

As regards the influence upon the position of the striker piece 34, four ranges may be distinguished in the guide or alignment member 50. In the entry range $\sigma'$ the distance between the guideface 51 and the circular path about the center of rotation of striker piece 34 is reduced. Following a range $\sigma''$, over which a constant distance is maintained, there is a further range $\sigma'''$ over which the distance is reduced. Finally, over the range $\sigma''''$, the guideface 37 of striker piece 34 and guideface 51 come in contact with one another at least partially and without play to thereby fix the position of the striker piece. In the illustrated example guideface 51 of guide member 5 reduces the angular play $\delta$ of the striker piece 34 over the range $\sigma'''$ in order to fix the striker piece in position free of play at range $\sigma''''$. It may also be advantageous to start the reduction of the angular play $\delta$ at ranges $\sigma'$ as well as $\pi''$.

The striking of guideface 37 against guideface 51 during the stressing of striker lever 3 may be reduced or even eliminated if the impact angle of the two surfaces is relatively flat. The shape of guideface 37 on striker piece 34 may be subdivided into an entry range $\Gamma$, an alignment range $\Gamma''$ as well as a holding range $\Gamma'''$, as is shown in FIG. 3*a*, to enable low-impact cooperation of the two guidefaces 37 and 51.

In addition, the angular velocity of the striker lever 3 during stressing may be influenced with appropriately shaped cam discs, so that, for example, over the range where the two guidefaces 37 and 51 first make contact, the angular velocity is correspondingly low.

Impact between guidefaces 37 and 51 may be further reduced by making the alignment member 50 flexible, particularly in a direction perpendicular to the weft path of the projectile, for example, by constructing the alignment member of a soft material such as plastic or by resiliently supporting the alignment member 50.

Figure 6C:
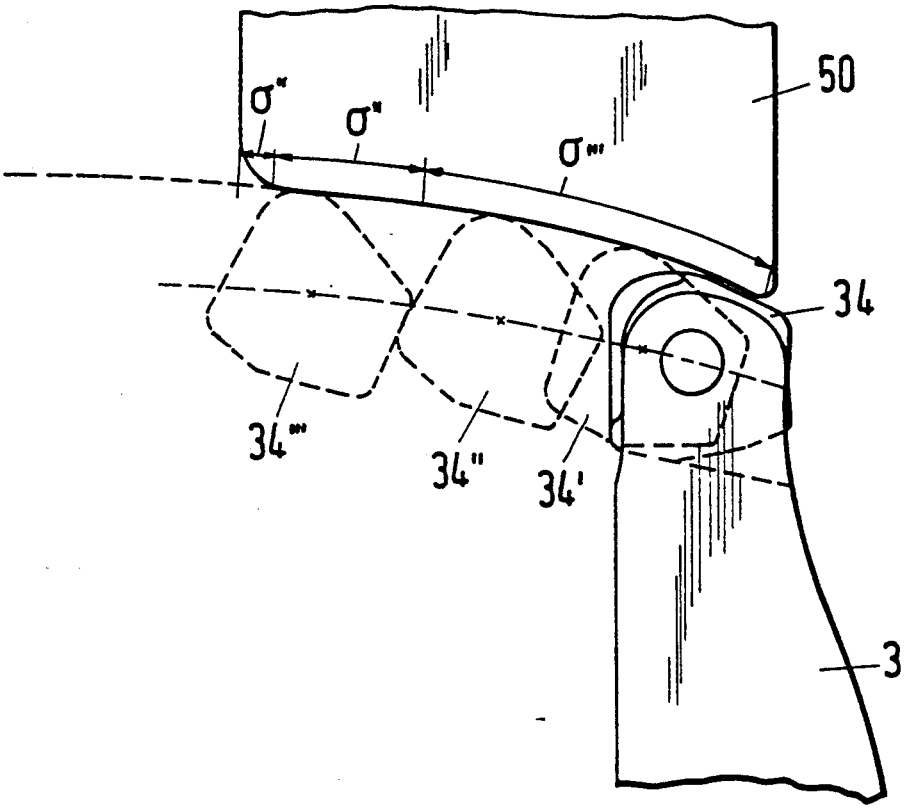
FIG. 6*c* also shows the action of an alignment member on the position of the striker piece during the stressing of the striker lever.

FIG. 6*c* shows the striker lever 3 and the associated striker piece 34 after stressing has been concluded. It also shows different positions 34''', 34'' and 34' of the striker piece during the stressing of the striker lever 3. In contrast to FIG. 6*b*, the range $\sigma''''$ over which the position of the striker piece 34 is fixed is lacking. As a result, striker piece 34 exhibits slight angular play in its starting position.

Figure 7:
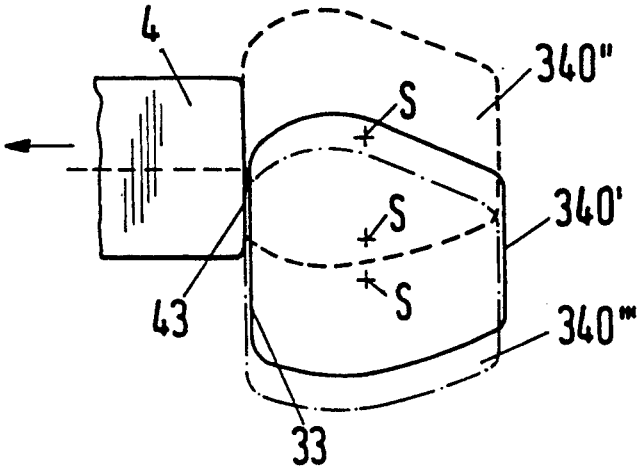
FIG. 7 shows the position of the striker piece relative to the projectile during acceleration of the projectile.

The position of the striker piece 34 relative to the projectile 4 during the acceleration phase of the projectile 4 is shown in FIG. 7. On leaving the position 340*a* at the start of acceleration, the striker piece moves relative to the projectile to the position of maximum acceleration 340''. The acceleration of the projectile terminates at position 340'''. While maintaining contact, striker face 33 slides perpendicularly to the weft direction across impact face 43. At least from the start of acceleration at 340' to the point of maximum acceleration at 340'' the center of gravity S of the striker piece in the direction of launch lies within impact face 43 of the projectile. Any tilting of the striker piece resulting in a loss of the flat, face-to-face contact should take place, at the earliest, towards the end of the acceleration of the projectile in the vicinity of position 340'''.

Figure 8:
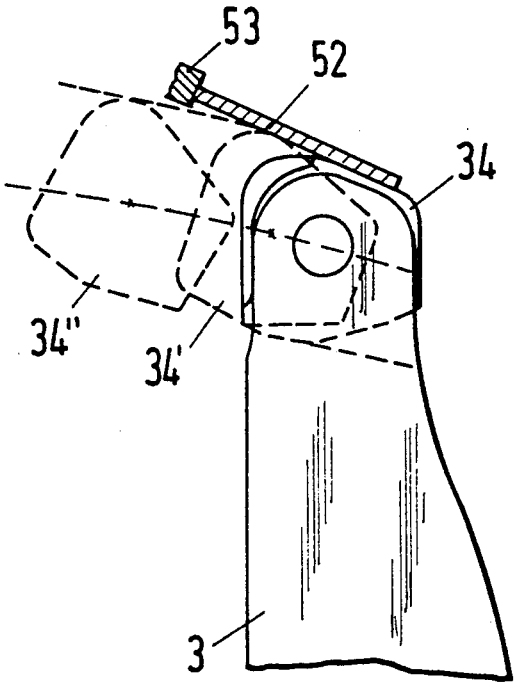
FIG. 8 shows a spring-like alignment member.

A further embodiment of an alignment member is shown in FIG. 8. The alignment member 52 is made like a spring; e.g. a leaf spring secured to a clamping member 53. The clamping member may also be resilient so that the alignment member 52 may be a rigid body. The alignment member 52 and clamping member 53 may of course form part of alignment member 50, for example, by having the alignment member define holding range $\sigma''''$.

Figure 9:
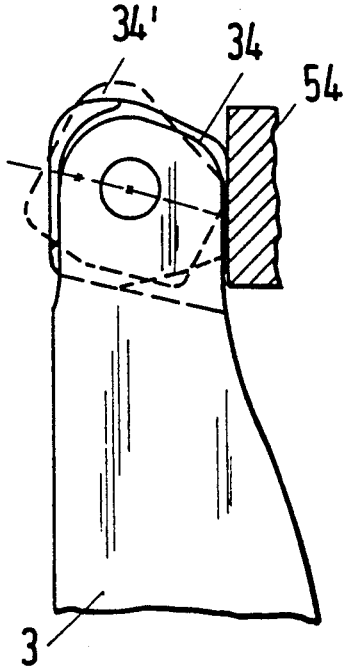
FIG. 9 shows a further alignment member.

Another embodiment of an alignment member is shown in FIG. 9. In the terminal phase of stressing striker lever 3, striker piece 34' (shown in dotted lines) meets alignment member 54 at a preferably very low angular velocity. The further pivoting of the striker lever causes alignment member 54 to align striker piece 34. Resilient properties of the alignment member in the launching direction of projectile 4 are advantageous.

Figure 10:
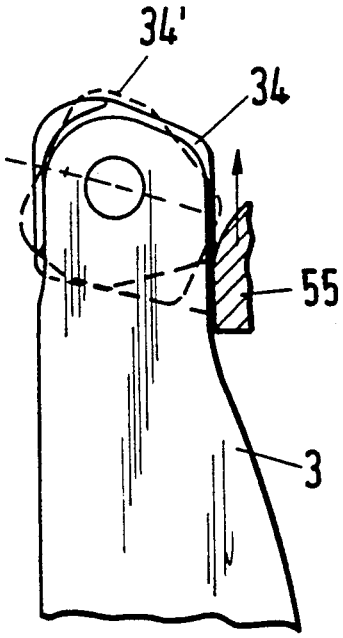
FIG. 10 shows an actively moved alignment member.

As shown in FIG. 10, striker piece 34 may alternatively be aligned with an active, motor-driven alignment member 55 which, for example, in the starting position of the striker lever prior to triggering the weft insertion, adjusts the inclination of the striker piece with a linear or pivotal motion.

What is claimed is:

1. A mechanism adapted for use on a projectile loom for accelerating a projectile of the loom by applying an accelerating force to an impact surface of the projectile, the mechanism comprising: a torsion bar for generating the accelerating force; a striker lever having a first end fixed to the torsion bar and a second end remote from the torsion bar; a striker piece movably secured to the second end of the striker lever and including a striker face adapted to apply the accelerating force directly to the impact surface of the projectile, the striker piece being movable with the lever along a circular path; and an alignment member acting on the striker piece for influencing a position of the striker piece relative to the striker lever during the application of the accelerating force to the impact surface of the projectile so that the position of the striker piece conforms to the shape of the impact face on the projectile.

2. A mechanism according to claim 1 including means for pivotally securing the striker piece to the second end of the striker lever, and wherein the striker piece is adapted to be rotationally balanced about its pivot axis at the second end of the striker lever.

3. A mechanism according to claim 1 wherein the striker piece is configured as a polygon and includes a plurality of polygonal faces defining the striker face.

4. A mechanism according to claim 1 wherein the striker piece includes a single, planar striker face adapted to steadily act on the impact face of the projectile during the application of the accelerating force.

5. A mechanism according to claim 4 wherein the striker piece has a relatively wider part and a relatively narrower part in the direction of pivotal movement about an axis of the torsion bar, and wherein the relatively wider part forms the striker face.

6. A mechanism according to claim 4 wherein the striker piece is U-shaped and defines the planar striker face.

7. A mechanism according to claim 1 including means pivotally securing the striker piece to the second end of the striker lever and permitting relative pivotal movement of the striker piece through a predefined pivot angle.

8. A mechanism according to claim 7 wherein the alignment member includes an alignment surface for influencing the position of the striker piece, and wherein the striker piece includes a curved guideface cooperating with the alignment surface and defining an entry range, a striker piece alignment range, and a striker piece holding range which successively are acted upon by the alignment surface of the alignment member when the striker member is moved from a position in which the torsion bar is relatively unstressed to a position in which the torsion bar is relatively stressed.

9. A mechanism according to claim 7 wherein the alignment member includes means restricting the angle through which the striker piece can pivot relative to the striker lever at least during a terminal phase of pivotal striker lever movement to torsionally fully stress the torsion bar.

10. A mechanism according to claim 7 wherein the alignment member includes a curved alignment face engaging the striker piece during pivotal striker lever movement to torsionally fully stress the torsion bar, the alignment face defining at least a first, striker piece entry range and a second, striker piece alignment range.

11. A mechanism according to claim 10 wherein the second alignment range of the curved alignment face is formed to reduce possible pivotal movement of the striker piece relative to the striker lever to a fraction of its possible pivotal movement prior to the engagement of the striker piece by the curved alignment face.

12. A mechanism according to claim 10 wherein the curved alignment face of the alignment member defines a final, holding range substantially preventing pivotal movements of the striker piece relative to the striker lever.

13. A mechanism according to claim 7 wherein the alignment member includes means stopping pivotal movements of the striker lever about the axis of the torsion bar when the torsion bar is in a fully stressed position and simultaneously limiting pivotal movements of the striker piece relative to the striker lever.

14. A mechanism according to claim 7 wherein the alignment member includes motor-operated means for limiting the extent of pivotal movements of the striker piece relative to the striker lever when the striker lever is in a position corresponding to a maximum torsional stressing of the torsion bar.

15. A mechanism according to claim 1 wherein the striker piece has a center of gravity, and wherein the striker piece is positioned so that the center of gravity falls within the impact surface on the projectile in the direction of movement of the projectile when subjected to the accelerating force at least until the striker piece and therewith the projectile are subjected to maximum acceleration.

16. A mechanism according to claim 1 wherein the alignment member and the striker piece define cooperating means positioning the striker face substantially parallel to the impact face of the projectile before, at or after the application of the accelerating force to the impact face of the projectile.

17. A mechanism according to claim 1 wherein at least a portion of the alignment member acting on the striker piece is resiliently displaceable.

18. A projectile loom comprising: a projectile for the insertion of weft yarn and including an impact surface to which a projectile accelerating force is to be applied; a torsion bar for generating the accelerating force; a striker lever having a first end secured to the torsion bar and a second end remote from the torsion bar; a striker piece movably secured to the second end of the striker lever, including a striker face adapted to apply the acceleration force to the impact surface of the projectile and movable with the lever along a circular path; and an alignment member acting on the striker piece for influencing a position of the striker piece relative to the striker lever during the application of the accelerating force to the impact surface of the projectile so that the position of the striker piece conforms adapted to the shape of the impact face on the projectile.

19. A projectile loom comprising: a plurality of projectiles for inserting weft yarns from a launching position for the projectiles, each projectile having an impact face; means for feeding the projectiles to the launching position; a torsion bar for generating a projectile launching force; a striker lever having a first end attached to the torsion bar for pivotal movement therewith and a free end located in a vicinity of the launching position; a striker piece movably carried by the free lever end and defining a striker face for engaging the impact face of a projectile at the launching position, the striker face and the impact face being oriented generally transversely to a projectile launching direction; whereby a release of the torsion bar following its torsional stressing pivotally moves the lever and the striker piece in the launching direction and transfers the launching force generated by the torsion bar to the projectile to thereby launch the projectile; and a striker piece alignment member forming a curved guide surface positioned to engage the striker piece when the lever is pivoted opposite to the launching direction to torsionally stress the torsion bar, the alignment member moving the striker piece relative to the lever so that an orientation of the striker surface relative to the impact face of the projectile is controlled by the guide surface of the alignment member when the lever and therewith the striker piece are in a trigger position corresponding substantially to a state of maximum torsional stress in the torsion bar.

20. A projectile loom according to claim 19 wherein the impact face and the striker face are substantially parallel when the striker piece and the striker lever are in said positions.

21. A projectile loom according to claim 19 wherein a distance between the striker face and the impact face is a fraction of a millimeter when the projectile is in the launching position and the striker piece and the striker lever are in said trigger position.

* * * * *